United States Patent [19]

Christine

[11] Patent Number: 4,932,562

[45] Date of Patent: Jun. 12, 1990

[54] LIQUID DISPENSING SYSTEM

[75] Inventor: William C. Christine, Nazareth, Pa.

[73] Assignee: Triparte, Ltd., Nazareth, Pa.

[21] Appl. No.: 187,676

[22] Filed: Apr. 29, 1988

[51] Int. Cl.[5] ..... B65D 37/00; G01F 11/28

[52] U.S. Cl. ..... 222/96; 222/214; 222/450; 222/476; 222/491; 137/844

[58] Field of Search ..... 282/212, 213, 214, 215, 282/491, 494, 95, 96, 41, 511, 105, 450, 476; 137/844, 847

[56] References Cited

U.S. PATENT DOCUMENTS

| | | | |
|---|---|---|---|
| 2,707,481 | 5/1955 | Kaplan et al. | 222/494 |
| 2,815,150 | 12/1957 | Herzig | 222/491 |
| 3,009,498 | 11/1961 | Fohr | 222/527 |
| 3,066,832 | 12/1962 | Rossetti | 222/214 |
| 3,184,121 | 5/1965 | Volckening | 222/541 |
| 3,451,120 | 6/1969 | Herzig et al. | 222/491 |
| 3,539,081 | 11/1970 | Norton | 222/185 |
| 3,610,477 | 10/1971 | Herzig | 222/494 |
| 3,825,157 | 7/1974 | Herzig | 222/494 |
| 3,881,641 | 5/1975 | Pliml, Jr. et al. | 222/207 |
| 4,098,434 | 7/1978 | Uhlig | 222/95 |
| 4,124,150 | 11/1978 | Moss | 222/494 |
| 4,130,224 | 12/1978 | Norman et al. | 222/185 |
| 4,163,509 | 8/1979 | Amneus | 222/494 |
| 4,252,257 | 2/1981 | Herzig | 222/491 |
| 4,256,242 | 3/1981 | Christine | 222/494 |
| 4,349,133 | 9/1982 | Christine | 222/183 |
| 4,463,876 | 8/1984 | Swallert | 222/183 |
| 4,500,061 | 2/1985 | Nigro | 248/359 |
| 4,546,904 | 10/1985 | Frassanito | 222/185 |
| 4,564,127 | 1/1986 | Garahedian et al. | 222/185 |
| 4,570,827 | 2/1986 | Roggenburg, Jr. et al. | 222/95 |
| 4,634,022 | 1/1987 | O'Italloran et al. | 222/95 |
| 4,667,854 | 5/1987 | McDermott et al. | 222/105 |
| 4,690,307 | 9/1987 | Hogan | 222/95 |
| 4,711,373 | 12/1987 | Christine | 222/95 |

FOREIGN PATENT DOCUMENTS

| | | | |
|---|---|---|---|
| 608568 | 12/1959 | Canada | 222/96 |

*Primary Examiner*—Andres Kashnikow
*Assistant Examiner*—Christopher G. Trainor
*Attorney, Agent, or Firm*—Seidel, Gonda, Lavorgna & Monaco

[57] ABSTRACT

The instant invention, is directed to a liquid dispensing system, especially for soap. The system comprises a housing, and a flexible pouch for storing liquid which is held within the housing and which has a discharge nozzle. A mechanism for pumping the liquid from the pouch is operatively associated with the housing. A valve mechanism for checking the flow of the liquid from the pouch includes a mechanism for laterally tensioning the pouch proximate its discharge nozzle so that the tension created is greater than a static pressure head of the liquid in the pouch but less than the dynamic pressure head created by the pumping mechanism.

15 Claims, 8 Drawing Sheets

FIG. 1
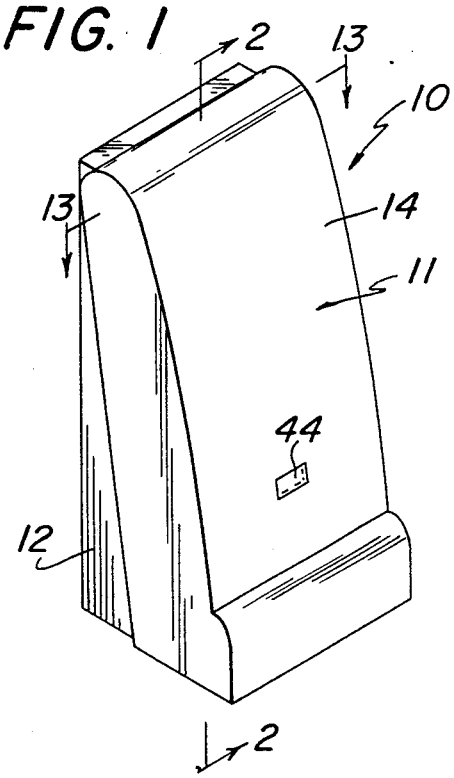
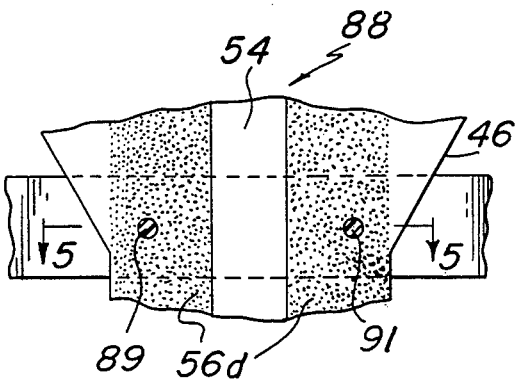
FIG. 4
FIG. 5
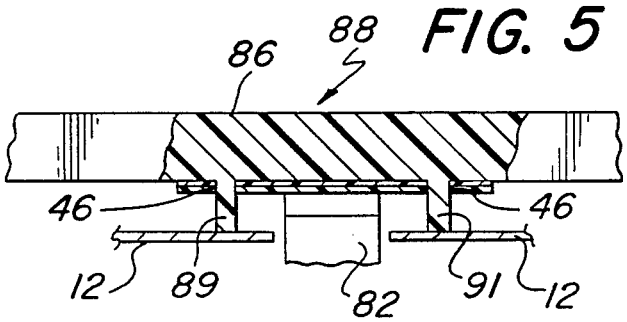
FIG. 6
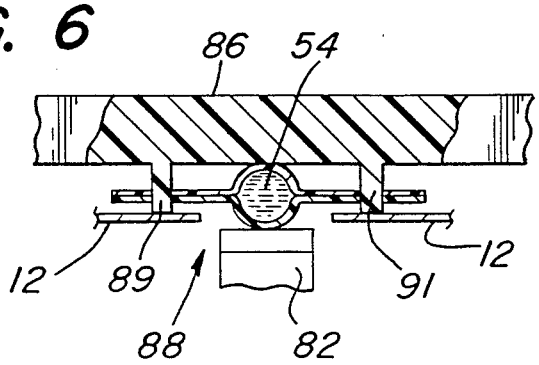

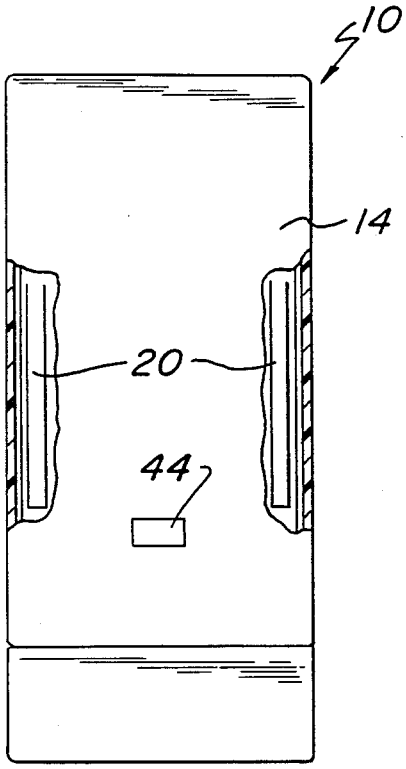
FIG. 3
FIG. 8
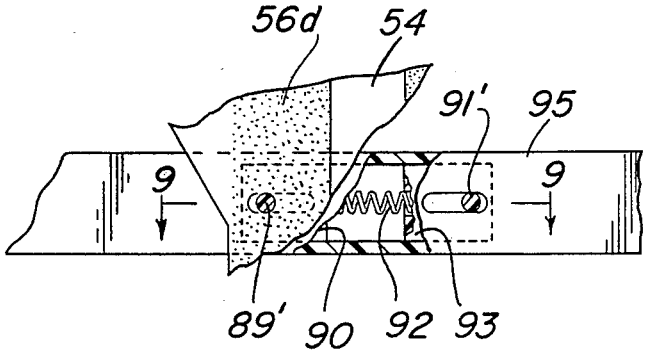
FIG. 9
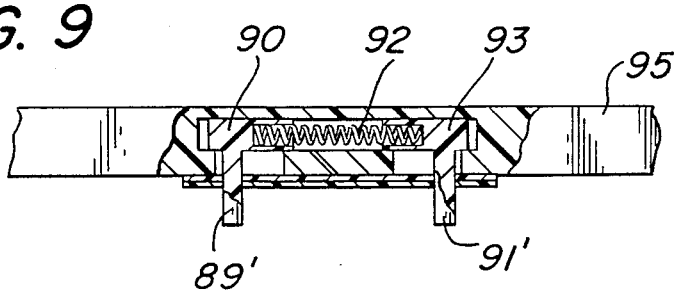

LIQUID DISPENSING SYSTEM

SCOPE OF THE INVENTION

The present invention is directed to a liquid dispensing system, preferably for dispensing a liquid soap. The system generally comprises a housing, a liquid storage pouch, a pumping mechanism, and a check valve mechanism. The check valve mechanism includes lateral tension elements.

BACKGROUND OF THE INVENTION

Heretofore liquid soap dispensers have been known. For example, see U.S. Pat. Nos. 4,349,133; 4,546,904; 4,667,854; and 4,463,876. These dispensers, however, have complex check valve mechanisms which are expensive to manufacture and difficult to maintain. These drawbacks increase the cost of the dispenser and reduce the dispenser's reliability.

U.S. Pat. No. 4,349,133 discloses a liquid dispenser and refill package. The dispenser has a housing, a flexible plastic pouch, a pumping mechanism, and a check valve mechanism. The housing has a front half and a rear half which are joined together by a hinge. A pouch is supported within and removable from the housing. The pouch includes a reservoir and a tubular pumping section in fluid communication with the reservoir. A "duck bill" check valve for preventing liquid leakage from the pumping section is located at the free end of the pumping section of the pouch. In FIG. 6 of U.S. Pat. No. 4,349,133, the "duck bill" check valve is illustrated. The "duck bill" valve is a plastic cylindrical closure having a diametric slit thereacross which is normally closed but openable when the liquid is pressurized by the pump. The pumping mechanism is contained within the housing and operates on the pumping section of the pouch. The pumping mechanism comprises a first block and a second block which sandwich the pumping section and squeeze the pumping section when forced together. The second block is mounted on a lever hinged to the housing. The lever actuates the pumping mechanism when grasped and pulled forward.

U.S. Pat. No. 4,546,904 is directed to a dispenser and a package for liquid which is similar to the dispenser described in U.S. Patent No. 4,349,133. The check valve of this patent has two embodiments: the first is a ball and spring valve (FIG. 5); the second, a slit diaphragm valve (FIG. 4).

U.S. Pat. No. 4,667,854 is directed to a liquid dispenser similar to those discussed above, except the pumping mechanism includes a roller which travels along the length of the pumping section, thereby squeezing liquid out of the pumping section. The check valve (FIGS. 5 and 6) comprises a nozzle which has a small opening. The small opening combined with the surface tension of the liquid apparently prevents leakage from the pouch.

U.S. Pat. No. 4,463,876 discloses a liquid dispenser that has a pouch (See FIGS. 1 and 5). The pouch has a reservoir section, a pumping or metering section, and a discharge nozzle. A resilient plate attached to the front half of the housing compresses the pumping section of the pouch when the housing adjacent the plate is pushed.

With regard to liquid storage pouches, U.S. Pat. Nos. 3,610,477, 3,825,157 and 4,252,257 are deemed relevant to the check valve mechanisms in general, even though not specifically adapted for use in dispensers. U.S. Pat. Nos. 3,825,157 and 4,252,257 are cumulative of U.S. Pat. No. 3,610,477 and accordingly are not discussed.

U.S. Pat. No. 3,610,477 discloses a pouch having a nozzle that has a "lateral bow". The term "lateral" apparently means from the top layer to the bottom layer of the pouch and not from side-to-side of the pouch. The "bow" is best illustrated in FIG. 1A. The lateral bow of the top and bottom layers apparently cause them to bear against one another and thereby close the nozzle.

Additionally, note FIGS. 2A, 2B and 3 which illustrate "dimples".

The foregoing liquid dispensing systems and pouches are unnecessarily complex in structure and in operation, and, therefore, are difficult and expensive to manufacture and difficult to maintain.

SUMMARY OF THE INVENTION

The liquid dispenser system described hereinafter overcomes the drawbacks of the dispensing systems discussed above by providing a simple check valve mechanism which is inexpensive to manufacture and easy to maintain. The instant dispensing system obtains this result by being effective without being complex, and by keeping the operative parts of the check valve mechanism out of direct contact with the liquid. Thus, a dry or extremely viscous liquid does not foul the operation of check valve mechanism.

The instant invention, in one aspect, is directed to a liquid dispensing system. The system comprises a housing; a pouch for storing liquid which is held within the housing and which has a flexible discharge nozzle; a mechanism for pumping the liquid from the pouch which is operatively associated with the housing; and a valve mechanism for checking the flow of the liquid from the pouch. The check valve includes a mechanism for laterally tensioning the pouch proximate its discharge nozzle so that the tension created is greater than a static pressure head of the liquid above the nozzle but less than a dynamic pressure head created by the pumping mechanism.

The pouch is used to store the liquid within the housing. The pouch comprises a reservoir, a pumping section and discharge nozzle, and means for receiving the lateral tension elements. The reservoir, pumping section and discharge nozzle are in serial fluid communication. A tearaway seal is also provided at the discharge nozzle. The means for receiving the lateral tension elements are openings located on opposite sides of the discharge nozzle. The openings are equally spaced from the discharge nozzle.

DESCRIPTION OF THE DRAWING

For the purpose of illustrating the invention, there is shown in the drawings a form which is presently preferred; it being understood, however, that this invention is not limited to the precise arrangements and instrumentalities shown.

FIG. 1 is an isometric view of a liquid dispensing system made according to the present invention.

FIG. 3 is a front elevational view of the present invention with parts broken away to illustrate a leaf spring for the pumping mechanism.

FIG. 4 is a sectional view taken generally along sectional line 4—4 of FIG. 2, and further illustrates the first embodiment of the check valve mechanism.

FIG. 5 is a sectional view taken generally along line 5—5 of FIG. 4, and illustrates the first embodiment of the check valve mechanism as well as the pouch while closed.

FIG. 6 is a sectional view corresponding to FIG. 5, illustrating the pouch while opened.

FIG. 8 is a sectional view taken along line 8—8 of FIG. 7, illustrating the second embodiment of the check valve mechanism.

FIG. 9 is a sectional view taken along line 9—9 of FIG. 8, illustrating the second embodiment of the check valve mechanism as well as the pouch while closed.

DETAILED DESCRIPTION OF THE INVENTION

Figure 2:
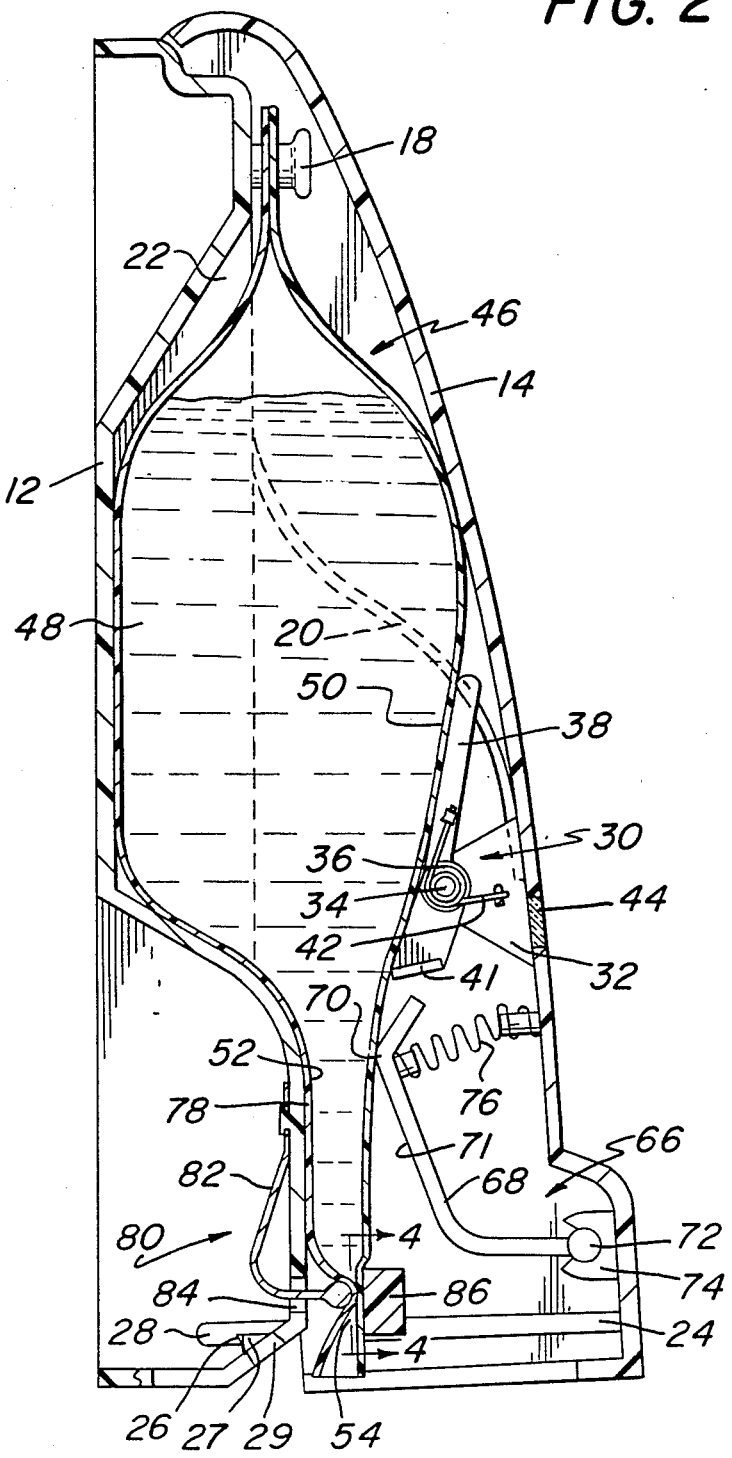
FIG. 2 is a sectional view of the present invention taken generally along line 2—2 of FIG. 1, illustrating, among other things, the pumping mechanism and a first embodiment of the check valve mechanism.

Referring to the drawings wherein like elements are denoted with like numerals, there is shown in FIG. 1, a liquid dispensing system 10. The dispensing system 10 is preferably used for dispensing a viscous liquid such as liquid soap. The dispensing system 10 disclosed herein will find its primary use as a dispenser of liquid hand soap in rest rooms.

The liquid dispensing system 10 generally comprises: a housing 11; a pouch 46 or 46, for storing the liquid 48; a pumping mechanism 66 for dispensing the liquid from the pouch; and a check valve mechanism 80 or 80, or 80″ for checking the flow of liquid from said pouch except when it is pumped. Each of these components of the liquid dispensing system are discussed in further detail below. To facilitate the description of the instant dispensing system, the following discussion revolves around these functional components of the system. The discussions are headed: "The Housing"; "The Pouch"; "The Pumping Mechanism"; and "The Check Valve Mechanism". The housing and pumping mechanism are the same for all embodiments. Three embodiments of the check valve mechanism are described. Two embodiments of the pouch are also described. The first embodiment of the pouch is used with the first two embodiments of the check valve. The second embodiment of the pouch is used with the third embodiment of the check valve. Finally, an overview of the system's operation is set forth.

THE HOUSING

Housing 11 is shown in FIG. 1. Housing 11 preferably comprises a rear section 12 and a front section 14. Rear section 12 is adapted to be mounted upon a wall in any conventional manner. Sections 12 and 14 are hinged together by bosses 16 protruding from section 12 into mating recesses in section 14. (See FIG. 13).

Figure 13:
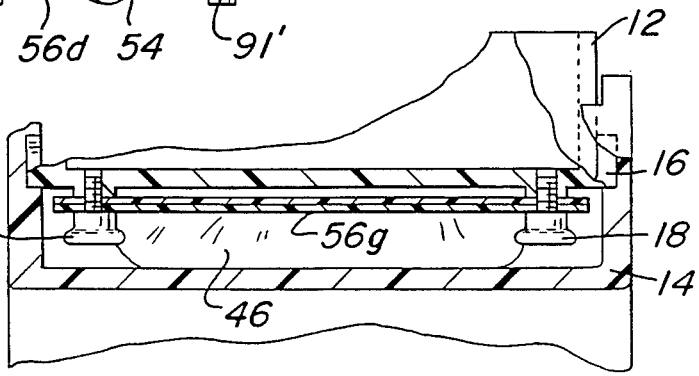
FIG. 13 is a sectional view taken generally along line 13—13 of FIG. 1.

Pouch 46, discussed in greater detail below, is secured within housing 11 on rear section 12 by a pair of removable fasteners 18 (See FIGS. 2, 7 & 13). The fasteners hold the pouch within the housing. Fasteners 18 may be of any type and may be readily removed and replaced. Fasteners 18 are screw-type fasteners but other convenient means of attaching the pouch may be used.

Sections 12 and 14 are biased to a pivotably open position by leaf springs 20. (See FIGS. 2, 3 and 7). Leaf springs 20 are optional, and when used, are for pivoting the front section 14 away from the fixed rear section 12. The upper ends of leaf springs 20 are fixed to the sides of rear section 12. The free ends of leaf springs 20 bear against and urge front section 14 away from rear section 12.

Rear section 12 is formed to provide a cavity 22. (See FIGS. 2 and 7) Cavity 22 facilitates receipt of the filled pouch 46 within housing 11 as illustrated.

Figure 10:
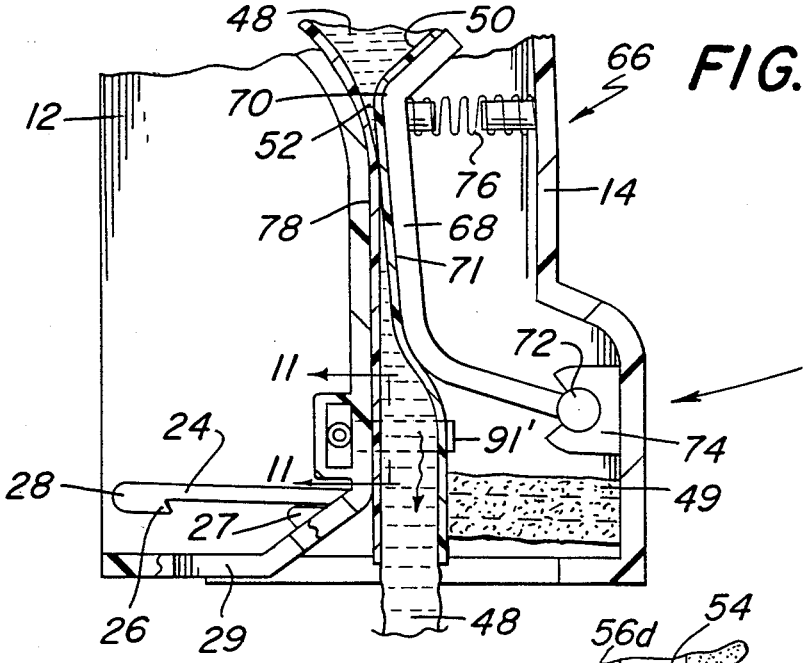
FIG. 10 is an enlarged sectional view of the lower portion of the liquid dispensing system similar to the one shown in FIG. 7, and when viewed in conjunction with FIG. 7 illustrates the operation of the pumping mechanism.
Figure 11:
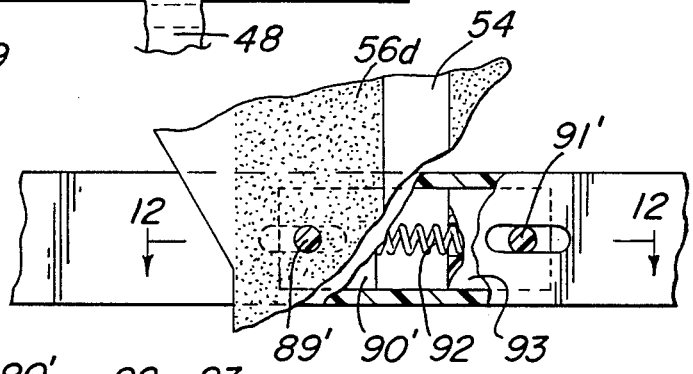
FIG. 11 is a sectional view taken generally along line 11—11 of FIG. 10, illustrating the check valve mechanism.
Figure 12:
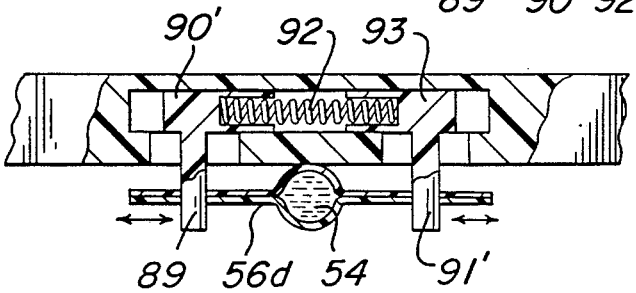
FIG. 12 is a sectional view taken generally along line 12—12 of FIG. 11, illustrating the pouch while opened.

Front section 14 is provided with a pivot limiting rod 24. (See FIGS. 2, 7 and 10). Rod 24 is mounted perpendicular to front section 14 and includes a forward pivot stop 26 and a rear pivot stop 28. In use, rod 24 limits the travel of front section 14. For example, in FIG. 2 front section 14 is shown in its "outward most" position. "Outward most", as used herein, means the front section is at its furthermost pivot position from the rear section without opening the housing for removal or replacement of the pouch. Stop 26, which is in the form of a catch, prevents further outward motion of front portion 14 by engaging a complementary catch 27 on the wall of rear section 12. In FIG. 10, front section 14 is shown in its "inward most" position. "Inward most", as used herein, means the position of front section 14 when it is pushed to actuate the pumping mechanism as described in further detail below. Stop 28, which is an enlarged end of rod 24, prevents further inward travel of front section 14 for example, by engaging the wall upon which the rear section 12 is mounted. Rod 24 is an elongated, cantilever member which flexes when an excess load is applied to end 28. To open the housing 11, rod 24 may be flexed upwardly by projecting a finger through hole 29 thereby, disengaging stop 26 from the catch 27 and allowing front section 14 to be pivoted open for the removal or replacement of pouch 46.

Figure 14:
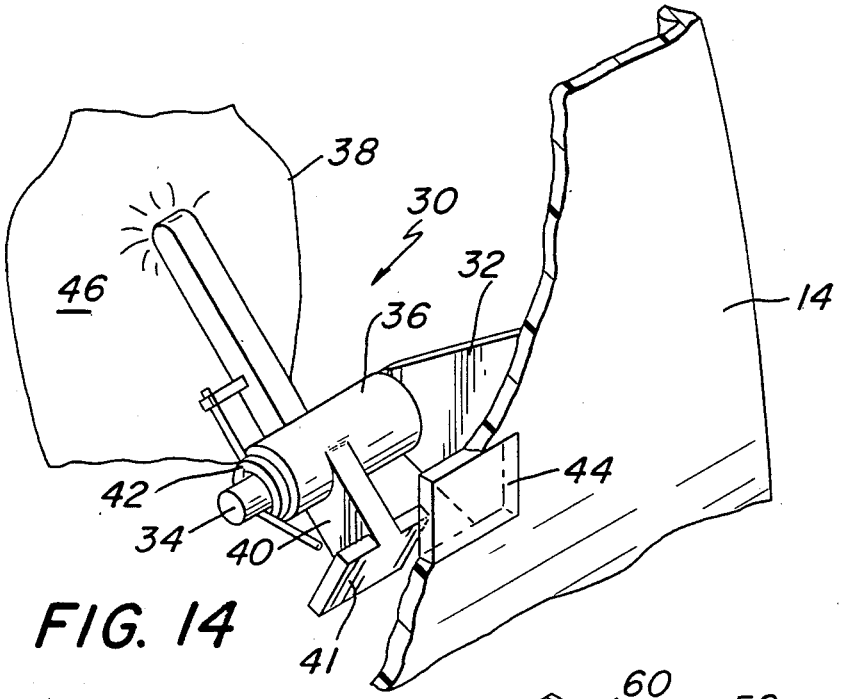
FIG. 14 is an isometric view, with parts broken away for clarity, of a liquid level indicating gauge.

Liquid level gauge 30 (See FIGS. 14, 2 and 7) is optionally provided as a feature of dispensing system 10. Gauge 30 indicates the level of liquid contained within pouch 46. Generally, gauge 30 comprises supports 32 which are mounted perpendicularly to front section 14 adjacent a window 44. Only one support is shown. Pin 34 is mounted perpendicularly to support 32. A sleeve 36 is rotatably mounted on pin 34. An arm 38 extends from sleeve 36 and bears against pouch 46. An indicator arm 40, also extends from sleeve 36, and is diametrically opposed to arm 38. The length of arm 40 is less than the distance between pin 34 and window 44. An indicator 41 is mounted on the end of arm 40. A coil spring 42 interconnects arm 38 and one of the supports 32. Spring 42 urges arm 38 into engagement with pouch 46. In operation, as liquid is removed from pouch 46, arm 38 collapses with pouch 46. Thus, indicator 41 becomes visible through window 44. When the pouch 46 is completely empty, indicator 41 is completely visible within window 44.

THE POUCH

Figure 15:
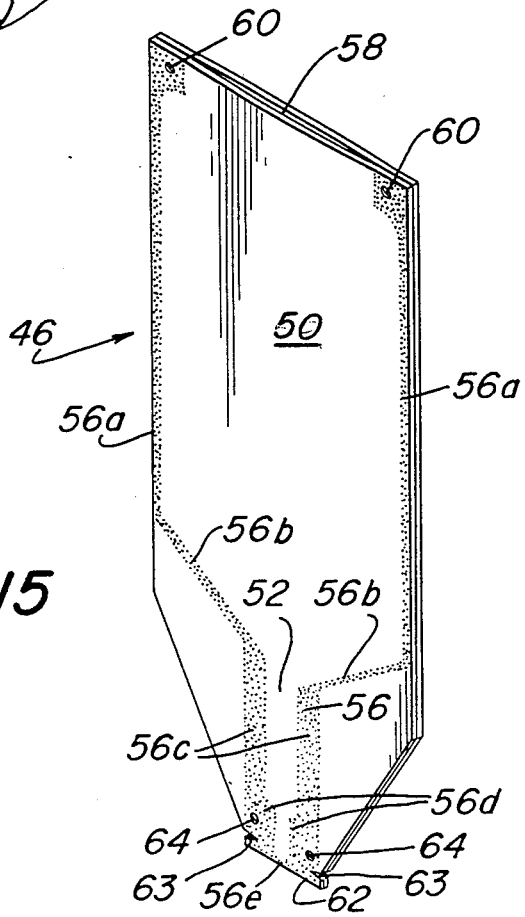
FIG. 15 is an isometric view of a first embodiment of the pouch, made according to the present invention, but prior to filling the pouch with liquid.

Liquid dispensing system 10 includes a pouch 46 for storing liquid 48. Two embodiments of pouch, 46 and 46'' are provided. (See FIGS. 15 and 17, respectively.) The primed numerals refer to corresponding parts of the second embodiment. The placement of the pouch within dispensing system 10 is illustrated in FIGS. 2, 7 and 13. Generally, pouch 46 (46,) comprises a reservoir 50 (50'), a pumping section 52 (52,), a discharge nozzle 54 (54'), a tearaway seal 62 (62,) and openings 64, 64, for receiving the bilateral tension elements to be described hereinafter. The pouch is made of a flexible thermoplastic material in a form, fill and seal apparatus of the type described in U.S. Pat. Nos. 4,512,136 or 3,894,381 or 4,246,062, which are incorporated herein by reference, or such other apparatus as is practicable. "Thermoplastic material", as used herein, refers to, but is not limited to, a high polymer that softens when exposed to heat and returns to its original condition when cooled to room temperature. Such materials include polyethylene, polypropylene, and PVC.

Reservoir 50 (50,), pumping section 52 (52'), and discharge nozzle 54 (54,) are defined by a weldment 56 (56') and are in serial fluid communication. Weldment 56 (56') is formed by thermally welding one layer of the thermoplastic pouch material to another layer, as is well known in the art. Of course, other joining techniques, for example, gluing or ultrasonic welding, can be used instead of thermal welding.

Figure 16:
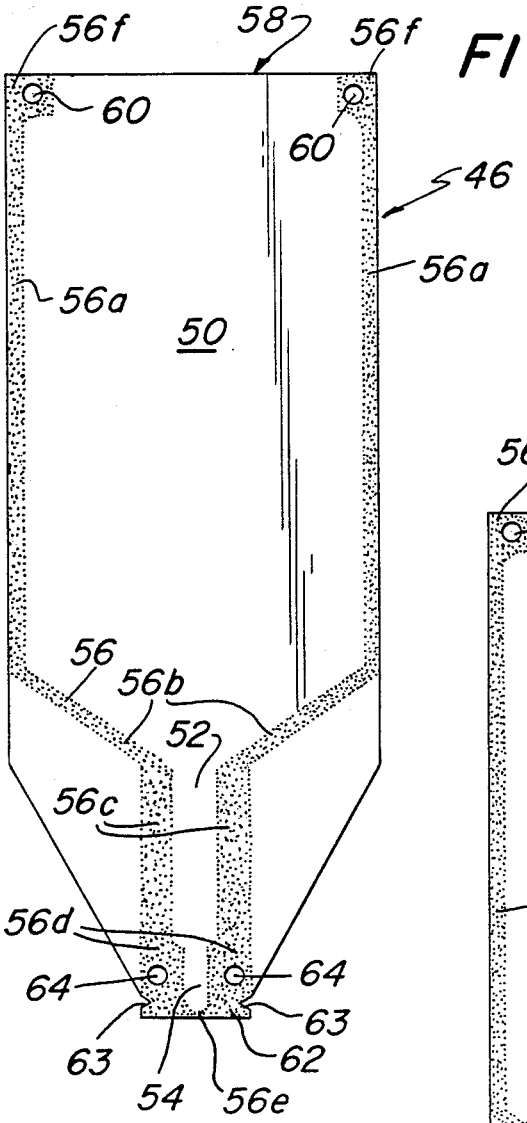
FIG. 16 is a front elevational view of the pouch illustrated in FIG. 15.

Referring to FIG. 16, weldment 56 preferably comprises the following parts. Since, the second embodiment 46'is similar to the first embodiment 46 in substantial part, only pouch 46 will be discussed in detail except when pouch 46, differs therefrom. Side reservoir weldment **56*a* define, in part, the reservoir 50 and are preferably parallel to one another. Slanted weldments 56*b* define the lower section of the reservoir 50 and create a tapered transition section between reservoir 50 and pumping section 52. Lateral pumping weldments 56*c* form the pumping section 52. Weldments 56*c* are preferably wider and pumping mechanism will create a dynamic pressure upon the liquid in section 52 during pumping. Nozzle weldments 56*d* define nozzle 54, and are preferably even wider than seals 56*c*. A wider weldment 56*d* is desireable because a lateral tension or stretching force is exerted across the nozzle 54 by the check valve mechanism discussed below. Nozzle weldments 57, of pouch 46, not only define nozzle 54, but also define pockets 64, Finally, weldments 56*e* (56'*e*) runs the width of tearaway seal 62 (62,) and thereby seals discharge nozzle 54**.

A pair of holes 60 (60,) is provided in pouch 46 above reservoir section 50, i.e. adjacent the uppermost end of the pouch. Each hole 60 receives one fastener 18 of housing 11. (See FIG. 13). The weldments 56f surrounding each hole 60 is preferably wider than weldments 56a to provide sufficient strength to support the weight of a filled pouch. A fill port 58 is provided between holes 60 for filling pouch 46 with liquid. Refer to U.S. Pat. Nos. 4,512,136 or 3,894,381 or 4,246,062 (incorporated herein by reference) for further details about possible filling techniques. After the pouch 46 is filled, port 58 is sealed shut with, for example, a thermal weld **56*g* (See FIG. 13**).

Tearaway seal 62 (62,) is located at discharge nozzle 54 (54,). Seal 62 (62,) slightly overlaps and includes a section of the discharge nozzle 54 (54') such that when removed, discharge nozzle 54 (54,) is opened. Seal 62 (62,) includes a pair of cut-away notches 63 (63') to facilitate its removal from the remainder of the pouch.

Reservoir 50 has a greater volumetric capacity for liquid than pumping section 52. Pumping section 52 has a narrower width (measured between the weldments and across the unsealed sections therebetween) than reservoir section 50. Discharge nozzle 54 has a width (defined the same as above) less than that of pumping section 52.

Figure 17:
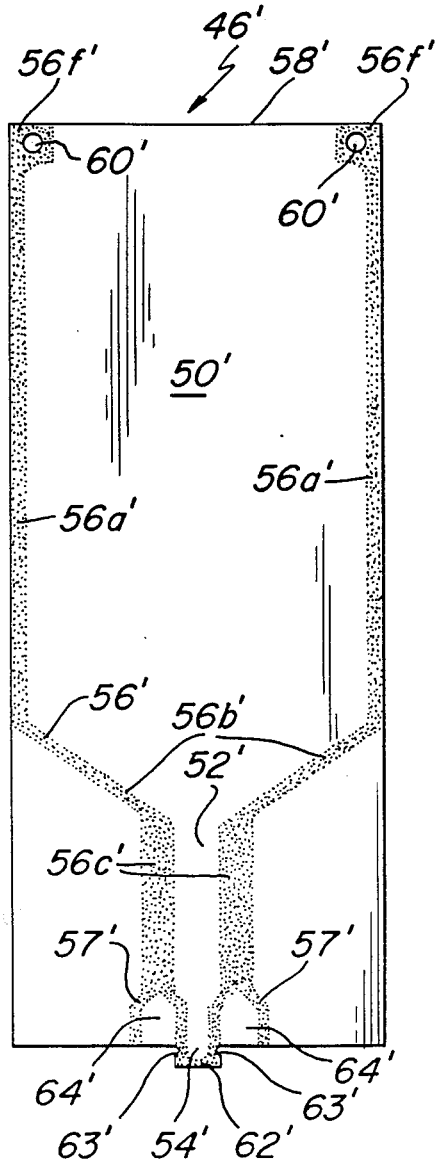
FIG. 17 is a front elevational view of an alternate embodiment of the pouch, made according to the present invention, prior to filling the pouch with liquid.

Openings for receiving bilateral tension elements 88 for example, holes 64 in FIG. 16 and pockets 64' in FIG. 17, are located on opposite sides of the discharge nozzle, within weldments **56*d* (57,), and are equally spaced from the end and sides of the discharge nozzle. The bilateral tension elements properly aligns the pumping section 52 (52,) of the pouch with the pumping mechanism described in greater detail below; and it is necessary to the operation of the check valve mechanism illustrated in FIGS. 2, 7 and 18**. For the efficient operation of the instant dispensing system, it is best that the pumping section of the pouch be properly aligned with the pumping mechanism. Any misalignment of the pumping section with the pumping mechanism could cause inefficient pumping.

The fluid checking function is provided by stretching or tensioning the discharge nozzle 54 (54,)of the pouch between the openings 64 (64'). This stretching action causes a tension across the nozzle which holds the nonsealed layers forming nozzle 54 (54,) together and thereby forms a yieldable closure. To facilitate this function, the pouch material may be slightly stretchable or elastic below its plastic deformation point. The tension created by stretching the nozzle 54 between the openings 64 (64') is greater than the static fluid head of the liquid when pouch 46 (46') is mounted in housing 11, but is less than the dynamic fluid head of the liquid within section 52 when the pumping mechanism is actuated.

This fluid checking feature is a major simplification over the fluid checking mechanism of the prior art because it greatly reduces the manufacturing cost of the pouch 46 (46') by eliminating the need for discrete check valves.

THE PUMPING MECHANISM

The liquid dispensing system 10 is provided with a pumping mechanism 66. (See FIGS. 2, 7 and 10). The pumping mechanism is preferably a peristaltic type pump although other pumping mechanisms can be utilized. The pumping mechanism 66 generally comprises a pivotable arm 68, a compression surface 78, and a spring 76. A pivot socket 74 is affixed to front section 14. Arm 68 is pivotably mounted in socket 74 via a rounded pin 72. Alternately, socket 74 and pin 72 may be replaced by a living hinge (not shown). The living hinge would be formed as part of arm 68, that is arm 68 would be made of flexible plastic material which could flex when folded. A terminal end of this arm 68 would be affixed to front section 14, then folded to from the living hinge.

Arm 68 is preferably bent as shown and includes a cut-off elbow 70 and a pumping surface 71. The compression surface 78 is formed on rear section 12 and faces pumping surface 71. Compression spring 76 is mounted between arm 68 and front section 14. The spring 76 is secured to the arm adjacent the cut-off elbow 70, i.e. at the distal end of arm 68.

Figure 7:
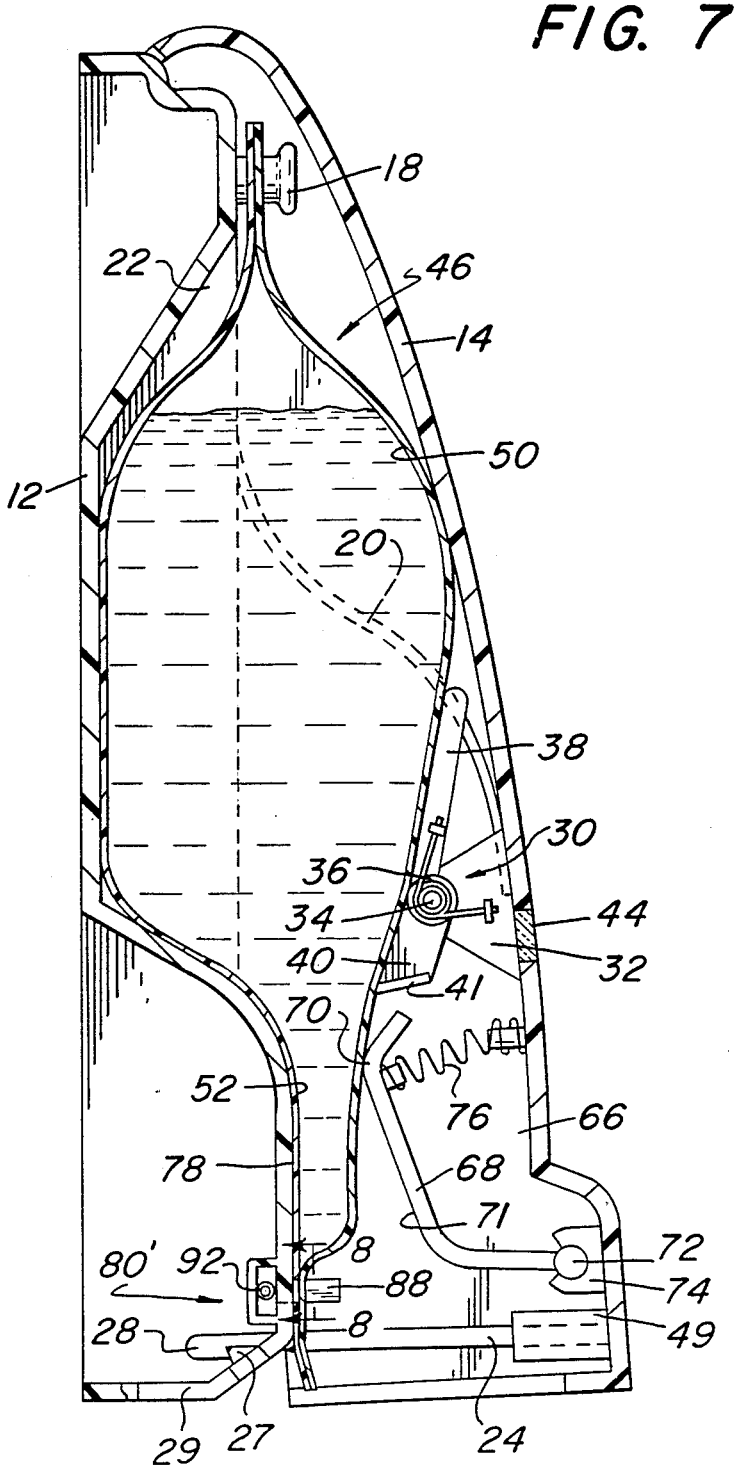
FIG. 7 is a sectional view of the present invention similar to FIG. 2, illustrating, among other things, a second embodiment of the check valve mechanism.

A rectangular block 49 of closed cell foam is optionally used to facilitate complete pumping of liquid from nozzle 54 of the embodiment illustrated in FIG. 7. The foam block 49 is affixed to front section 14 directly below socket 74. The foam block 49 does not engage nozzle 54 when front section 14 is at its outward most position (FIG. 7), but does engage nozzle 54 when front section 14 is at its inward most position (FIG. 10). Foam block 49 is preferably made of neoprene, but any closed cell resilient polymeric foam material may be used so long as when compressed, as shown in FIG. 10, it does not obstruct discharge of liquid from nozzle 54, but expands after discharge is complete.

Foam block 49 eliminates two problems arising from the operation of the embodiment shown in FIG. 7. First, extremely small amounts of liquid may accumulate in the discharge nozzle below the check valve in the absence of foam block 49. This causes the formation of a single drop of liquid which drips from the nozzle. The foam block eliminates this problem by acting as a squeegee, that is it forces the complete discharge of liquid from nozzle 54 below the check valve mechanism.

Second, during pumping nozzle 54 tends to move away from rear section 12 due to the force created during discharge of the liquid through the nozzle. The foam block eliminates this problem by holding the nozzle in place against the rear section 12.

In operation, the pump 66 is normally at the "outward most"position (See FIGS. 2 and 7). Front section 14 functions as an actuator. As front section 14 is urged toward its "inward most" position (see FIG. 10), cut-off elbow 70 engages pumping section 52 of pouch 46, thereby "cutting off" the flow of liquid from the reservoir 50 to pumping section 52. Pumping surface 71 thereafter engages pumping section 52 and squeezes the liquid within that section out through discharge nozzle 54 by compressing the pumping section 52 between pump surface 71 and compression surface 78. The pressure created within the pumping section (that is the dynamic head pressure) is sufficiently great to overcome the tensioning force of the check valve mechanism. When front section 14 is released, spring 76 and leaf springs 20, if present, urges front section 14 back to its outward most position.

THE CHECK VALVE MECHANISM

Figure 18:
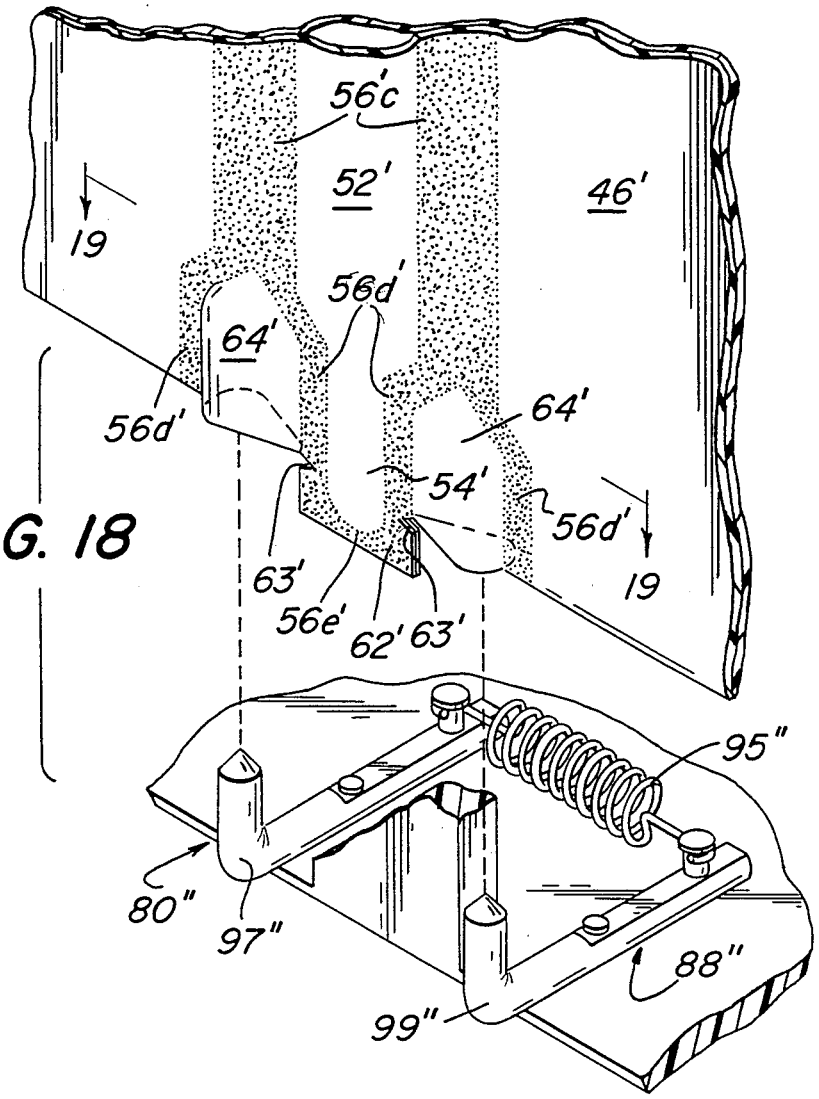
FIG. 18 is an exploded isometric view of a third embodiment of the check valve mechanism.

The liquid dispensing system 10 includes a check valve 80 for preventing the flow of fluid from pouch 46. The various embodiments of the check valve mechanism are differentiated by primed numerals. The alternate embodiments of this check valve mechanism 80 are illustrated in FIGS. 2, 7 and 18 and their corresponding sectional views. Each alternate embodiment of the check valve mechanism 80 is related in that it includes bilateral tension means 88, discussed hereinafter. The function of the bilateral tension elements is to grip or otherwise hold both sides of the discharge nozzle of the pouch so that a tension is applied across the nozzle with sufficient force to seal it.

The first embodiment of check valve mechanism 80, illustrated in FIG. 2 and corresponding FIGS. 4–6, comprises bilateral tension elements 89, 91 and optionally may include retainer bar 86 and leaf spring 82. The bilateral tension elements 88 comprise a pair of pins 89 and 91, spaced from one another a distance which is slightly greater than the distance between the openings 64 (holes) in pouch 46. Thus, when pouch 46 is affixed to the pins 89, 91, the discharge nozzle 54 of pouch 46 is stretched therebetween, i.e. laterally tensioned. The tension caused by this stretching action is greater than the static pressure head of the liquid within filled pouch 46, but it is less than the dynamic pressure head created by the pumping mechanism 66. Thus, when the pumping mechanism 66 is actuated, discharge nozzle 54 is forced opened and liquid passes therethrough. Optionally, leaf spring 82, which is mounted on the back of rear section 12, extends through hole 84 and presses the discharge nozzle 54 against retainer bar 86. Spring 82 and retainer bar 86 supplement tension means 88 but are not necessary to the flow checking function.

A second embodiment of the check valve 80' is illustrated in FIGS. 7–9 and 11–12. Pins 89', 91' are mounted on slides 90, 93. Slides 90, 93 support pins 89,, 91', respectively, and are mounted within hollow bar 95. Alternately, only one slide 90/pin 89, could be used and the other remote pin 91, could be fixed. A spring 92 is mounted between slides 90, 93 and urges them apart. Therefore bilateral tension pins 89,, 91, are urged away from one another. The spring has a force constant which is greater than the static pressure head of the fluid within pouch 46, but is less than the dynamic pressure head created by pumping mechanism 66.

Figure 19:
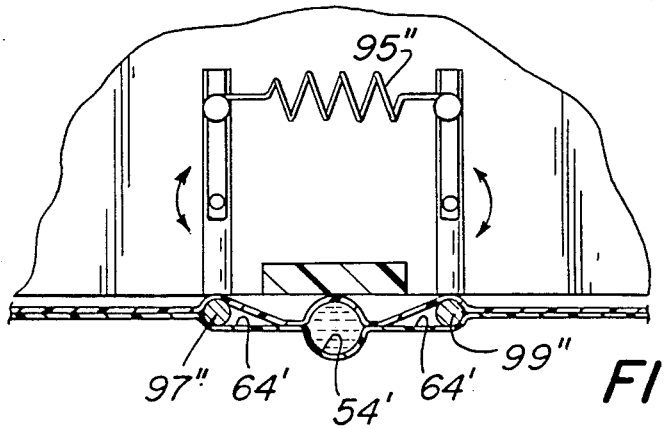
FIG. 19 is a sectional view taken generally along the line 19—19 of FIG. 18.

In a third embodiment of the check valve mechanism 80'' includes bilateral tension means 88'' See FIGS. 18 and 19. A tension spring 95,, urges the vertical section of the pivotably mounted L-shaped pins 97'', 99'' away from one another and thereby checks the flow of liquid from the pouch in the same manner described above. Alternately, only one of the pins 97'' or 99,, need be pivotable, the other being fixed.

From the above discussion it is readily apparent that the operative elements, i.e. the bilateral tension means, of the check valve mechanism do not come in direct contact with the liquid. Should any liquid become dry or extremely viscous or accumulate at the discharge nozzle, it will not foul the check valve's operation. This is due to the fact that the bilateral tension means does not come in direct contact with the liquid.

OPERATION OF THE SYSTEM

After a filled pouch 46 is secured within housing 11 via fasteners 18 (see FIG. 13) and the openings 64 or 64' are engaged on bilateral tension means 88 (88' or 88'') in the form of the pins 89, 91 (89,, 91, or 97,,, 99,,) (see FIGS. 4, 8, 11 and 18), the tearaway seal is removed and front section 12 is closed (see FIGS. 1, 2 and 7). Front section 12 is biased to its "outward most" position (see FIGS. 2 and 7) and the discharge nozzle 54 is closed (see FIGS. 5 and 9). The tension across the discharge nozzle 54 created by the bilateral tension means is greater than the static pressure head of the liquid in the filled pouch. Thus, liquid is checked from leaking from the pouch.

To dispense the liquid 48 from pouch 46, front section 12 is moved toward its "inward most" position (see FIG. 10). This actuates the pumping mechanism 66, as discussed above. The dynamic head pressure created by the pumping mechanism overcomes the lateral tension or stretching force created by the check valve mechanism 80 (80' or 80'') (see FIGS. 6, 12 and 19) whereby the discharge nozzle is opened and liquid is released (see FIG. 10). Upon release of the front section 12, spring 76 of the pumping mechanism 66, and optional leaf spring 20 if present, returns front section 12 to its "outward most" position. The dynamic pressure head created by the pumping mechanism 66 is no longer present and the tension provided by bilateral tension means 88 (88, or 88,,) of the check valve mechanism closes the discharge nozzle 54 (see FIG. 2, 5, 7, 8 and 9).

The present invention may be embodied in other specific forms without departing from the spirit or essential attributes thereof and, accordingly, reference should be made to the appended claims, rather than to the foregoing specifications, as indicating the scope of the invention.

I claim:

1. A liquid dispensing system comprising: a housing; liquid storing means removeably supported within said housing, said liquid storing means having a flexible discharge nozzle and adapted to retain a quantity of liquid therein; pumping means within said housing for pumping liquid from said storing means; and means on said housing for engaging the storing means adjacent the discharge nozzle, and for checking the flow of liquid from said storing means, said engagement means including means for applying a lateral transverse tension across said nozzle which is greater than the static pressure head of the liquid retained within said storing means but less than the dynamic pressure head created by said pumping means.

2. The system according to claim 1 wherein said engagement means further comprises a spring and a retainer, both being mounted within the housing, said discharge nozzle for said storing means removably positioned between said spring and said retainer, said spring being yieldable to said liquid when said liquid is pumped by said pumping means from said storing means through said discharge nozzle.

3. The system according to claim 1 wherein said lateral tension means comprises a pair of displaceable pins engaging said storing means on opposite sides of said nozzle, and means to bias said pins away from each other.

4. The system according to claim 3 wherein said lateral tension means comprises a pin pivotably biased away from another pin.

5. The system according to claim 1 wherein said lateral tension means comprises a pin slideably biased away from another pin.

6. The system according to claim 1 wherein said storing means includes means for receiving said lateral tension means.

7. The system according to claim 6 wherein said receiving means comprises a pair of holes, one said hole located on each lateral side of said discharge nozzle.

8. The system according to claim 6 wherein said receiving means comprises a pair of pockets, one said pockets located on each lateral side of said discharge nozzle.

9. The system according to claim 6 wherein said lateral tension means provides a tension to the pouch material that is below the plastic deformation point of the receiving means and the discharge nozzle.

10. The system according to claim 1 further comprising means for indicating the amount of liquid remaining in said storing means.

11. The liquid dispensing system according to claim 1 wherein said pumping means further comprises a block of resilient closed cell foam affixed to said housing, said foam block contacting said nozzle such that said block facilitates complete discharge of said liquid from said nozzle upon pumping.

12. A liquid dispenser for use in combination with a storage pouch for retaining a quantity of liquid therein and having a flexible discharge nozzle, the liquid dispenser comprising: a housing; means for pumping liquid from the pouch, said pumping means mounted within said housing; means mounted on said housing for laterally tensioning the discharge nozzle of the pouch, said tensioning means having two pouch engaging elements spaced a predetermined distance from one another and adapted to provide a lateral tension force across the pouch nozzle to check the flow of liquid through the nozzle against the static pressure head of the liquid within the pouch and the tensioning means yielding to the dynamic pressure within the pouch created by the pumping means.

13. The liquid dispenser according to claim 12 wherein spring means are provided to bias said elements away from one another to provide the tension force.

14. The liquid dispenser according to claim 12 wherein said pouch engagement elements comprise a pair of pins adapted to engage openings in the pouch.

15. A liquid dispensing system comprising: a housing; liquid storing means removably supported within the housing, said liquid storing means having a flexible discharge nozzle and adapted to retain a quantity of liquid therein; tension means mounted on the housing, the tension means having two engagement elements spaced a predetermined distance from one another in a fixed relationship; and engagement receiving means on the liquid storing means adjacent the flexible nozzle, the receiving means located in a fixed relationship on opposite sides of the nozzle, said tensioning means laterally tensioning the flexible nozzle to check the flow of liquid within the liquid storing means by the relationship between the engagement elements of the tension means on the housing and the engagement receiving means of the liquid storing means, the tensioning means removable from engagement with the liquid storing means upon removal thereof from the housing.

* * * * *